US011187242B2

(12) United States Patent
Kuroda et al.

(10) Patent No.: US 11,187,242 B2
(45) Date of Patent: Nov. 30, 2021

(54) MULTI-STAGE CENTRIFUGAL COMPRESSOR

(71) Applicant: MITSUBISHI HEAVY INDUSTRIES, LTD., Tokyo (JP)

(72) Inventors: Miku Kuroda, Tokyo (JP); Chihiro Myoren, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 11 days.

(21) Appl. No.: 16/784,380

(22) Filed: Feb. 7, 2020

(65) Prior Publication Data

US 2021/0003145 A1 Jan. 7, 2021

(30) Foreign Application Priority Data

Jul. 4, 2019 (JP) ..... JP2019-124903

(51) Int. Cl.
*F04D 29/44* (2006.01)
*F04D 17/12* (2006.01)

(52) U.S. Cl.
CPC ..... *F04D 29/441* (2013.01); *F04D 17/12* (2013.01)

(58) Field of Classification Search
CPC ..... F04D 17/12; F04D 29/441
See application file for complete search history.

(56) References Cited

U.S. PATENT DOCUMENTS 2,898,031 A * 8/1959 Voigt ..... F04D 21/00 415/211.1
9,976,564 B2 * 5/2018 Bueche ..... F04D 29/444
2002/0106278 A1 * 8/2002 Koga ..... F04D 17/122 415/211.2
2014/0369823 A1 * 12/2014 Yamashita ..... F04D 29/284 415/203
2016/0265539 A1 * 9/2016 Annati ..... F04D 29/4206

FOREIGN PATENT DOCUMENTS

JP 2018-173020 11/2018

* cited by examiner

*Primary Examiner* — Ninh H. Nguyen
(74) *Attorney, Agent, or Firm* — Wenderoth, Lind & Ponack, L.L.P.

(57) ABSTRACT

A multi-stage centrifugal compressor according to at least one embodiment includes: multiple stages of impellers arranged in an axial direction; a casing surrounding the impellers; and a diffuser channel for guiding a working fluid discharged from the impellers outward in a radial direction. In a cross-section along the axial direction, a first diffuser wall surface on a hub side of a pair of diffuser wall surfaces that are opposed in the axial direction across the diffuser channel has a retreating surface retreating toward the hub side from a connection position with a downstream end of a first upstream wall surface to a radially outer side with respect to a tangential direction of the first upstream wall surface at the downstream end of the first upstream wall surface, the first upstream wall surface being positioned upstream of the first diffuser wall surface and connected to the first diffuser wall surface.

6 Claims, 5 Drawing Sheets

MULTI-STAGE CENTRIFUGAL COMPRESSOR

TECHNICAL FIELD

The present disclosure relates to a multi-stage centrifugal compressor.

BACKGROUND

As a centrifugal compressor used in an industrial compressor, a turbo chiller, a small gas turbine, or a pump, a multi-stage centrifugal compressor including impellers with pluralities of blades mounted on disks fixed to a rotational shaft is known. The multi-stage centrifugal compressor provides pressure energy and velocity energy to a working fluid by rotating the impellers.

A pair of impellers adjacent each other in the axial direction of the rotational shaft is connected by a return channel (for example, see Patent Document 1).

CITATION LIST

Patent Literature

Patent Document 1: JP2018-173020A

SUMMARY

Such a multi-stage centrifugal compressor has a pair of wall surfaces that are axially opposed across the return channel. In addition, the multi-stage centrifugal compressor has a pair of diffuser wall surfaces that are axially opposed across a diffuser channel. A hub-side wall surface of the pair of diffuser wall surfaces is also referred to as a first diffuser wall surface.

In the multi-stage centrifugal compressor, separation of the working fluid may occur at a wall surface, connected to the first diffuser wall surface, of the pair of wall surfaces of the return channel.

Such separation may reduce the efficiency of the centrifugal compressor, so that it is desired to suppress the separation as much as possible.

In view of the above, an object of at least one embodiment of the present invention is to suppress a reduction in efficiency of a multi-stage centrifugal compressor.

(1) A multi-stage centrifugal compressor according to at least one embodiment of the present invention comprises: multiple stages of impellers arranged in an axial direction; a casing surrounding the impellers; and a diffuser channel for guiding a working fluid discharged from the impellers outward in a radial direction. In a cross-section along the axial direction, a first diffuser wall surface on a hub side of a pair of diffuser wall surfaces that are opposed in the axial direction across the diffuser channel has a retreating surface retreating toward the hub side from a connection position with a downstream end of a first upstream wall surface, positioned upstream of the first diffuser wall surface and connected to the first diffuser wall surface, to a radially outer side with respect to a tangential direction of the first upstream wall surface at the downstream end of the first upstream wall surface.

As described above, in the multi-stage centrifugal compressor, separation of the working fluid may occur at a wall surface, connected to the first diffuser wall surface, of the pair of wall surfaces of the return channel. The present inventors have keenly studied and consequently found that the separation is likely to occur in case of using an open impeller, i.e., an impeller having no cover on the tip side.

Specifically, when an open impeller is used as the impeller of the centrifugal compressor, a tip clearance is provided between the tip-side end of the impeller and the casing. Therefore, due to the presence of the tip clearance, the flow velocity of the working fluid at the tip side tends to be lower than at the hub side in an outlet-side portion of the impeller. The difference in flow velocity of the working fluid at the outlet side of the impeller also affects the flow velocity of the working fluid in the diffuser channel. At the outlet of the diffuser channel, the flow velocity in the vicinity of the tip-side wall surface (hereinafter also referred to as a second diffuser wall surface) of the pair of diffuser wall surfaces tends to be lower than the flow velocity in the vicinity of the first diffuser wall surface.

In the multi-stage centrifugal compressor, the diffuser channel and the return channel are connected by a return bend. The first diffuser wall surface is connected to a radially inner wall surface of the return bend, and the second diffuser wall surface is connected to a radially outer wall surface of the return bend.

The working fluid flowing out from the diffuser channel toward the radially outer side turns at the return bend toward the radially inner side and flows into the return channel. At this time, if the flow velocity of the working fluid flowing in the vicinity of the first diffuser wall surface is higher than the flow velocity of the working fluid flowing in the vicinity of the second diffuser wall surface, the working fluid flowing in the vicinity of the first diffuser wall surface cannot sufficiently turn at the return bend. Consequently, separation of the working fluid easily occurs at a wall surface, connected to the radially inner wall surface of the return bend, of the pair of wall surfaces of the return channel, i.e., at a wall surface connected to the first diffuser wall surface.

As a result of intensive studies by the present inventors, it was found that when the first diffuser wall surface has the retreating surface as described above, a hub-side flow-path cross-sectional area is increased in an inlet-side region of the diffuser channel. Accordingly, compared to the case where the first diffuser wall surface does not have the retreating surface, it is possible to reduce the flow velocity of the working fluid flowing in the vicinity of the first diffuser wall surface in the inlet-side region of the diffuser channel. Thus, since the difference between the flow velocity in the vicinity of the first diffuser wall surface and the flow velocity in the vicinity of the second diffuser wall surface is reduced, the working fluid flowing in the vicinity of the first diffuser wall surface easily turns at the return bend. Therefore, in the return channel, it is possible to suppress separation of the working fluid at the wall surface connected to the radially inner wall surface, i.e., at the wall surface connected to the first diffuser wall surface.

(2) In some embodiments, in the above configuration (1), the first diffuser wall surface has a first outer wall surface positioned on the radially outer side of the retreating surface. The first outer wall surface is disposed such that, in a cross-section along the axial direction, a downstream end of the first outer wall surface is situated on a line extending from an upstream end of the first outer wall surface toward the radially outer side or at a position retreating toward the hub side from the line, and in a cross-section along the axial direction, an angle between the line extending from the upstream end of the first outer wall surface toward the radially outer side and a line extending from the upstream end of the first outer wall surface toward the downstream end of the first outer wall surface is smaller than an angle between a line extending from an upstream end of the retreating surface toward the radially outer side and a line extending from the upstream end of the retreating surface toward a downstream end of the retreating surface.

With the above configuration (2), although the retreating surface is inclined toward the axial direction with respect to the radial direction, the inclination of the first outer wall surface toward the axial direction is controlled compared to the retreating surface. Thus, the downstream end of the first outer wall surface is positioned further axially upstream compared to the case where the inclination of the first outer wall surface toward the axial direction is not controlled. This enables a reduction in the length of the rotational shaft of the multi-stage centrifugal compressor, thus suppressing the occurrence of vibration of the rotational shaft. Further, since the length of the rotational shaft of the multi-stage centrifugal compressor is reduced, it is possible to prevent an increase in axial dimension of the multi-stage centrifugal compressor.

(3) In some embodiments, in the above configuration (1), the first diffuser wall surface has a first outer wall surface positioned on the radially outer side of the retreating surface. The first outer wall surface is disposed such that, in a cross-section along the axial direction, a downstream end of the first outer wall surface is situated at a position projecting toward a tip side from a line extending from an upstream end of the first outer wall surface toward the radially outer side.

With the above configuration (3), the downstream end of the first outer wall surface is positioned axially upstream of the line extending from the upstream end of the first outer wall surface toward the radially outer side. Thus, the downstream end of the first outer wall surface is positioned further axially upstream compared to the case where the downstream end of the first outer wall surface is positioned axially downstream of this line. This enables a reduction in the length of the rotational shaft of the multi-stage centrifugal compressor, thus suppressing the occurrence of vibration of the rotational shaft. Further, since the length of the rotational shaft of the multi-stage centrifugal compressor is reduced, it is possible to prevent an increase in axial dimension of the multi-stage centrifugal compressor.

(4) In some embodiments, in any one of the above configurations (1) to (3), a second diffuser wall surface on a tip side of the pair of diffuser wall surfaces has a projecting surface projecting toward the hub side from a connection position with a downstream end of a second upstream wall surface, positioned upstream of the second diffuser wall surface and connected to the second diffuser wall surface, to the radially outer side with respect to a tangential direction of the second upstream wall surface at the downstream end of the second upstream wall surface.

As a result of intensive studies by the present inventors, it was found that when the second diffuser wall surface does not have the projecting surface, the flow-path cross-sectional area in an outlet-side region of the diffuser channel relatively increases, and the flow velocity of the working fluid decreases in the vicinity of the second diffuser wall surface, which may cause backflow of the working fluid from the return bend.

With the above configuration (4), since the flow-path cross-sectional area of the diffuser channel is reduced compared to the case where the second diffuser wall surface does not have the projecting surface, it is possible to suppress backflow of the working fluid from the return bend as described above. Further, with the above configuration (4), it is possible to reduce the thickness of a boundary layer where the flow velocity is decreased due to the influence of the second diffuser wall surface in the vicinity of the second diffuser wall surface.

(5) In some embodiments, in the above configuration (4), the second diffuser wall surface on the tip side is disposed such that, in a cross-section along the axial direction, a downstream end of the projecting surface is situated on a line extending from an upstream end of the projecting surface toward the radially outer side or at a position projecting toward the hub side from the line, and in a cross-section along the axial direction, an angle between the line extending from the upstream end of the projecting surface toward the radially outer side and a line extending from the upstream end of the projecting surface toward the downstream end of the projecting surface is smaller than an angle between a line extending from an upstream end of the retreating surface toward the radially outer side and a line extending from the upstream end of the retreating surface toward a downstream end of the retreating surface.

With the above configuration (5), the downstream end of the projecting surface is positioned further axially upstream compared to the case where the angle between the line extending from the upstream end of the projecting surface toward the radially outer side and the line extending from the upstream end of the projecting surface toward the downstream end of the projecting surface is greater than the angle between the line extending from the upstream end of the retreating surface toward the radially outer side and the line extending from the upstream end of the retreating surface toward the downstream end of the retreating surface. This prevents the downstream end of the projecting surface from coming excessively close to the first diffuser wall surface, thus ensuring the flow-path cross-sectional area of the diffuser channel.

(6) In some embodiments, in the above configuration (5), the second diffuser wall surface has a second outer wall surface positioned on the radially outer side of the projecting surface. The second outer wall surface is disposed such that, in a cross-section along the axial direction, a downstream end of the second outer wall surface is situated at a position retreating toward the tip side from a line extending from an upstream end of the second outer wall surface toward the radially outer side.

With the above configuration (6), the downstream end of the second outer wall surface is positioned further axially upstream compared to the case where the downstream end of the second outer wall surface is positioned at a position projecting toward the hub side from the line extending from the upstream end of the second outer wall surface toward the radially outer side. This prevents the downstream end of the second outer wall surface from coming excessively close to the first diffuser wall surface, thus ensuring the flow-path cross-sectional area of the diffuser channel. Moreover, since the flow-path cross-sectional area of the diffuser channel is ensured as described above, it is unnecessary to dispose a region of the first diffuser wall surface facing the downstream end of the second outer wall surface further axially downstream than necessary. Thus, it is possible to reduce the length of the rotational shaft of the multi-stage centrifugal compressor.

(7) In some embodiments, in any one of the above configurations (4) to (6), an angle between a line extending from an upstream end of the projecting surface toward the radially outer side and a line extending from the upstream end of the projecting surface toward a downstream end of the projecting surface is smaller than an angle between a line extending from an upstream end of the retreating surface toward the radially outer side and a line extending from the upstream end of the retreating surface toward a downstream end of the retreating surface.

With the above configuration (7), since the distance to the projecting surface increases from the upstream end to the downstream end of the retreating surface, it is possible to reduce the flow velocity of the working fluid flowing in the vicinity of the first diffuser wall surface in the inlet-side region of the diffuser channel.

(8) In some embodiments, in any one of the above configurations (1) to (7), a length of the retreating surface in the radial direction is more than 5% and equal to or less than 20% of a length of the first diffuser wall surface in the radial direction.

As a result of intensive studies by the present inventors, it was found that when the length of the retreating surface in the radial direction is equal to or less than 5% of the length of the first diffuser wall surface, the effect of reducing the flow velocity of the working fluid flowing in the vicinity of the first diffuser wall surface in the inlet-side region of the diffuser channel is decreased. Accordingly, with the above configuration (8), it is possible to effectively reduce the flow velocity of the working fluid flowing in the vicinity of the first diffuser wall surface in the inlet-side region of the diffuser channel.

Meanwhile, as the length of the retreating surface in the radial direction increases, in addition to that the effect of reducing the flow velocity of the working fluid increases, the length of the rotational shaft increases since the downstream end of the retreating surface is positioned axially downstream. Therefore, vibration of the rotational shaft may easily occur.

As a result of intensive studies by the present inventors, it was found that when the length of the retreating surface in the radial direction is equal to or less than 20% of the length of the first diffuser wall surface, vibration of the rotational shaft is suppressed while ensuring the effect of reducing the flow velocity of the working fluid as much as possible. Accordingly, with the above configuration (8), it is possible to suppress vibration of the rotational shaft while ensuring the effect of reducing the flow velocity of the working fluid as much as possible.

(9) In some embodiments, in any one of the above configurations (1) to (8), an angle between a line extending from an upstream end of the retreating surface toward the radially outer side and a line extending from the upstream end of the retreating surface toward a downstream end of the retreating surface is more than 5° and less than 10°.

As a result of intensive studies by the present inventors, it was found that when the angle is equal to or less than 5°, the effect of reducing the flow velocity of the working fluid flowing in the vicinity of the first diffuser wall surface in the inlet-side region of the diffuser channel is decreased. Accordingly, with the above configuration (9), it is possible to effectively reduce the flow velocity of the working fluid flowing in the vicinity of the first diffuser wall surface in the inlet-side region of the diffuser channel.

Meanwhile, as the angle increases, in addition to that the effect of reducing the flow velocity of the working fluid increases, the length of the rotational shaft may increase since the downstream end of the retreating surface is positioned axially downstream. Therefore, vibration of the rotational shaft may easily occur.

As a result of intensive studies by the present inventors, it was found that when the angle is less than 10°, vibration of the rotational shaft is suppressed while ensuring the effect of reducing the flow velocity of the working fluid as much as possible. Accordingly, with the above configuration (9), it is possible to suppress vibration of the rotational shaft while ensuring the effect of reducing the flow velocity of the working fluid as much as possible.

(10) In some embodiments, in any one of the above configurations (1) to (9), with a distance between the first diffuser wall surface on the hub side and a second diffuser wall surface on a tip side of the pair of diffuser wall surfaces at an inlet-side end of the diffuser channel being 100%, a distance between the first diffuser wall surface and the second diffuser wall surface at an outlet-side end of the diffuser channel is equal to or more than 90% and equal to or less than 110%.

When the distance at the outlet-side end is less than 90%, the flow velocity in the diffuser channel does not sufficiently decreases, resulting in an increase in pressure loss and a reduction in efficiency of the multi-stage centrifugal compressor. Accordingly, with the above configuration (10), it is possible to suppress the reduction in efficiency of the centrifugal compressor. Meanwhile, when the distance at the outlet-side end is more than 110%, the flow-path cross-sectional area in the outlet-side region of the diffuser channel relatively increases, and, as described above, the flow velocity of the working fluid decreases in the vicinity of the second diffuser wall surface, which may cause backflow of the working fluid from the return bend. Accordingly, with the above configuration (10), it is possible to suppress backflow of the working fluid from the return bend.

According to at least one embodiment of the present invention, it is possible to suppress a reduction in efficiency of a multi-stage centrifugal compressor.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

(Overall Configuration of Multi-Stage Centrifugal Compressor 100)

Figure 1:
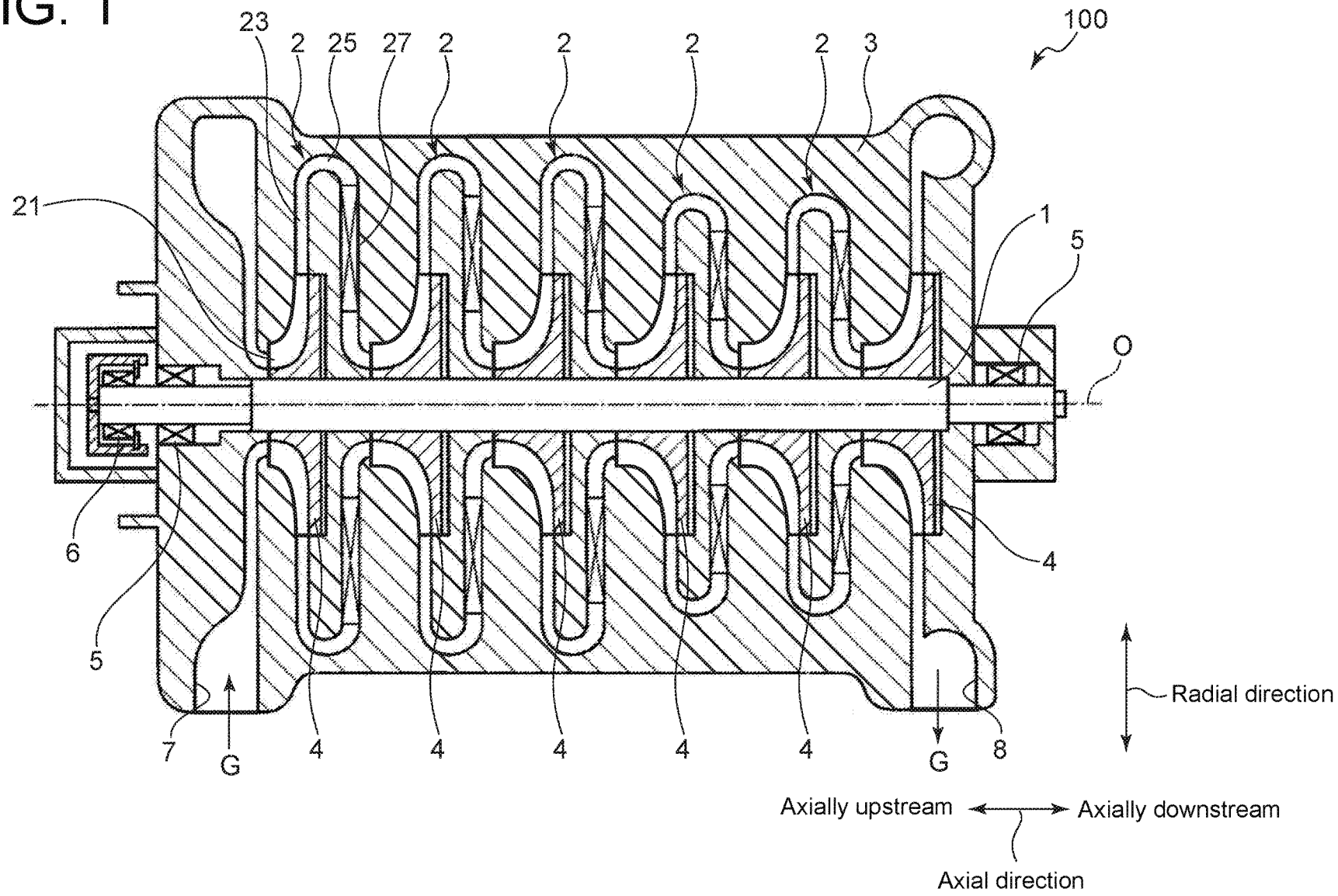
FIG. 1 is a schematic cross-sectional view of a multi-stage centrifugal compressor according to some embodiments.
Figure 2:
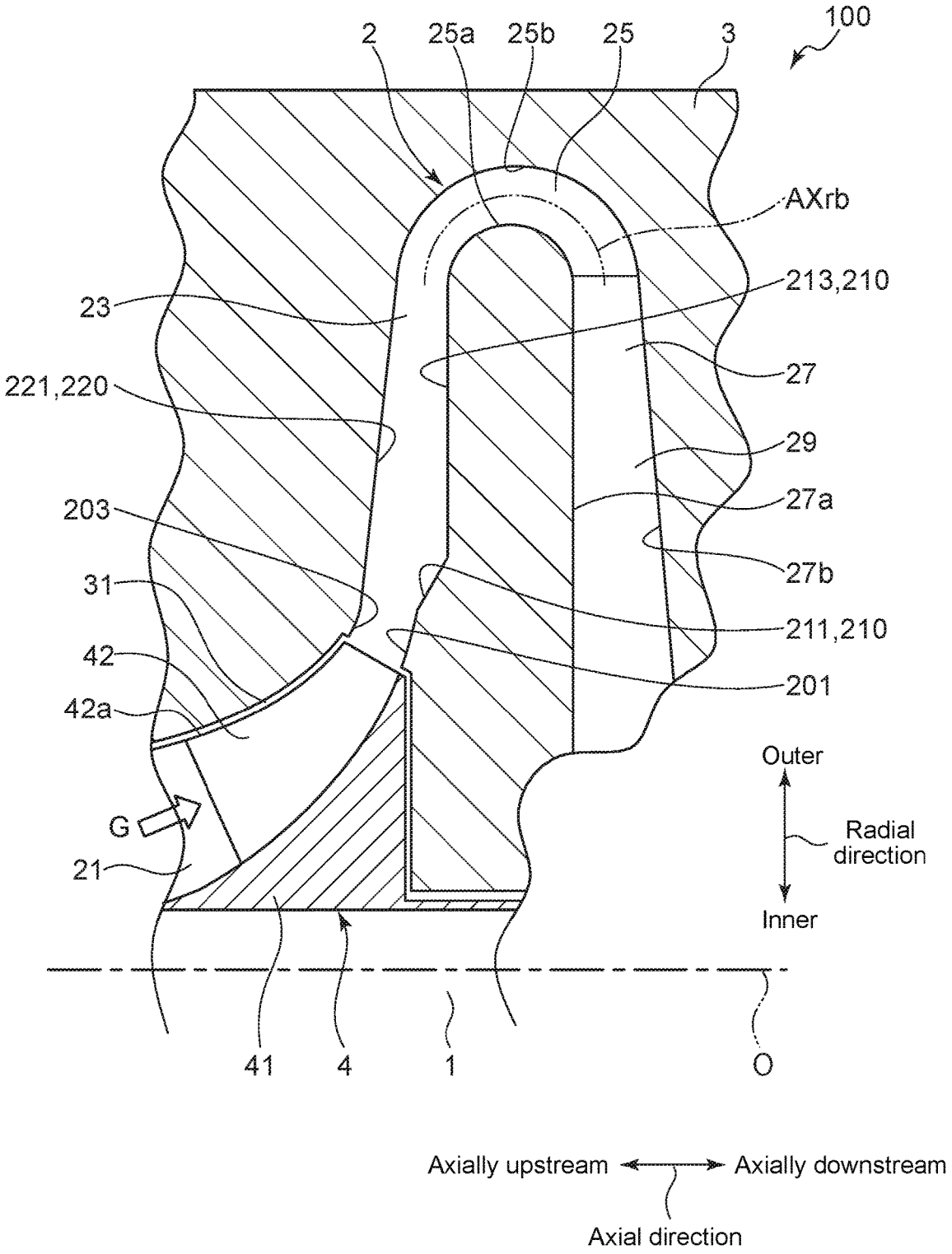
FIG. 2 is a schematic enlarged view of a part of a cross-section of a multi-stage centrifugal compressor according to an embodiment.
Figure 3:
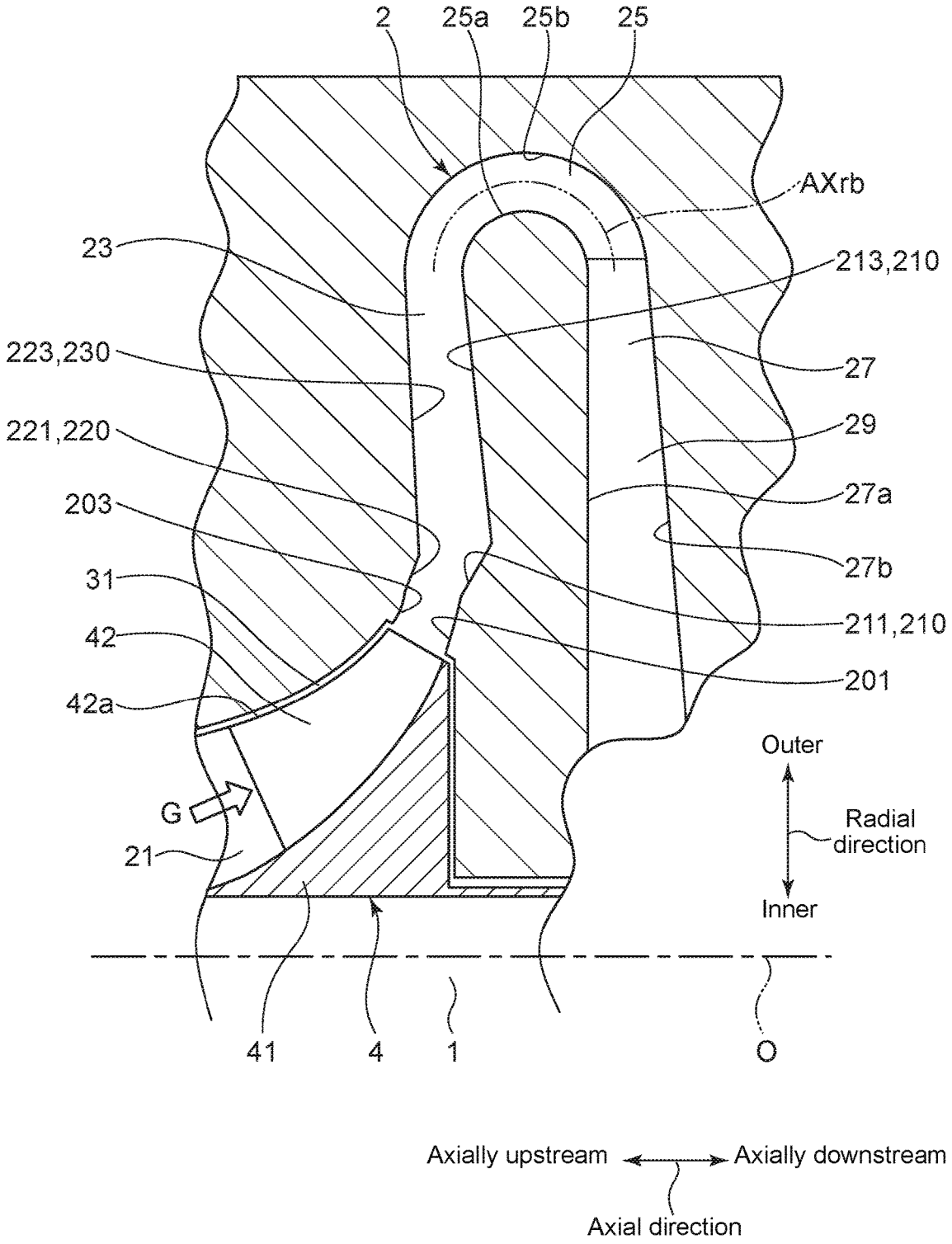
FIG. 3 is a schematic enlarged view of a part of a cross-section of a multi-stage centrifugal compressor according to another embodiment.

FIG. 1 is a schematic cross-sectional view of a multi-stage centrifugal compressor 100 according to some embodiments, taken along an axis O of a rotational shaft 1. FIG. 2 is a schematic enlarged view of a part of a cross-section of the multi-stage centrifugal compressor 100 according to an embodiment. FIG. 3 is a schematic enlarged view of a part of a cross-section of the multi-stage centrifugal compressor 100 according to another embodiment.

To avoid complication of the drawings, FIG. 1 does not show the detailed shape of a flow path 2 depicted in FIG. 2 and following figures.

As shown in FIG. 1, the multi-stage centrifugal compressor 100 according to some embodiments includes a rotational shaft 1, multiple stages of impellers 4 arranged in the axial direction of rotational shaft 1 with respect to the rotational shaft 1, a casing 3 surrounding the impellers 4, and a flow path 2. The casing 3 forms the flow path 2 by covering the circumference of the rotational shaft 1.

The casing 3 has a cylindrical shape extending along the axis O. The rotational shaft 1 extends along axis O and passes through the inside of the casing 3. At both ends of the casing 3 in the axis O direction, a journal bearing 5 and a thrust bearing 6 are disposed, respectively. The rotational shaft 1 is supported by the journal bearing 5 and the thrust bearing 6 in a rotatable manner about the axis O.

On one axial side of the casing 3, an intake port 7 is provided to intake air from the outside as a working fluid G. On the other axial side of the casing 3, an exhaust port 8 is provided to exhaust the working fluid G compressed inside the casing 3.

Inside the casing 3, the intake port 7 and the exhaust port 8 communicate with each other and form an interior space with a fluctuating diameter. The interior space houses the impellers 4 and forms a part of the flow path 2.

In the following description, on the flow path 2, the side with the intake port 7 is simply referred to as upstream, and the side with the exhaust port 8 is simply referred to as downstream.

Further, in the following description, the direction of the axis O of the rotational shaft 1 is also simply referred to as the axial direction. With respect to the direction along the axis O of the rotational shaft 1, the side with the intake port 7 is referred to as the axially upstream, and the side with the exhaust port 8 is referred to as axially downstream.

In the following description, the radial direction about the axis O of the rotational shaft 1 is also simply referred to as the radial direction, the inner side in the radial direction about the axis O is also simply referred to as the radially inner side, and the outer side in the radial direction about the axis O is also simply referred to as the radially outer side. Further, in the following description, the circumferential direction about the axis O of the rotational shaft 1 is also simply referred to as the circumferential direction.

The rotational shaft 1 is provided with a plurality of (e.g., six) impellers 4 arranged on the outer peripheral surface at intervals in the axis O direction. For example, as shown in FIG. 2, each impeller 4 has a disk (hub) 41 with a substantially circular cross-section when viewed from the axial direction, and a plurality of blades 42 disposed on an upstream surface of the disk 41.

The disk 41 is shaped such that, when viewed from a direction intersecting the axis O, the radial dimension gradually increases from one side to the other in the axial direction, and thus has a substantially cone shape.

The blades 42 are arranged radially around the axis O toward the radially outer side, on the upstream-facing cone surface among both surfaces of the disk 41 in the axial direction. More specifically, the blades 42 are formed by thin plates oriented upstream from the upstream surface of disk 41. These blades 42 are curved from one side to the other in the circumferential direction when viewed from the axial direction.

The impeller 4 according to some embodiments does not have a cover 43 on upstream edges of the blades 42. In other words, the impeller 4 according to some embodiments is a so-called open impeller.

The flow path 2 is a space communicating with the interior space of the casing 3. This embodiment is based on the premise that one flow path 2 is formed for one impeller 4 (one compression stage). More specifically, for instance, the multi-stage centrifugal compressor 100 according to some embodiments has five continuous flow paths 2 from upstream to downstream corresponding to five impellers 4 except for the last-stage impeller 4.

Each flow path 2 includes an intake channel 21, a diffuser channel 23, a return bend 25, and a return channel 27. In FIG. 2, among the impellers 4 and flow paths 2, the first-stage impeller 4 and flow path 2 thereof are shown.

In the first-stage impeller 4, the intake channel 21 is directly connected to the intake port 7. The intake channel 21 allows external air to be drawn into the channels on the flow path 2 as the working fluid G.

Although not shown in FIGS. 2 and 3, the intake channels 21 of the impellers 4 in the second and later stages each communicate with the downstream end of the return channel 27 of the flow path 2 in the previous stage (first stage).

The diffuser channel 23 extends from the radially inner side to the radially outer side. The diffuser channel 23 serves to guide the working fluid compressed by the impeller 4 and discharged, toward the radially outer side. For example, as shown in FIGS. 2 and 3, the multi-stage centrifugal compressor 100 according to some embodiments has a pair of diffuser wall surfaces 210, 220 that are axially opposed across the diffuser channel 23 in a cross-section along the axial direction. The diffuser wall surface 210 on the hub side (axially downstream side) of the pair of diffuser wall surfaces 210, 220 is also referred to as a first diffuser wall surface 210, and the diffuser wall surface 220 on the tip side (axially upstream side) is also referred to as a second diffuser wall surface 220.

The return bend 25 serves to change the flow direction of the working fluid G flowing out from the diffuser channel 23 toward the radially outer side so as to be directed toward the radially inner side. The upstream end of the return bend 25 is connected to the downstream end of the diffuser channel 23. The downstream end of the return bend 25 is connected to the upstream end of the return channel 27.

The multi-stage centrifugal compressor 100 according to some embodiments has a first bend wall surface 25*a* connected to the first diffuser wall surface 210 and positioned on the radially inner side of the central axis AXrb along the extension direction of the return bend 25. The multi-stage centrifugal compressor 100 according to some embodiments has a second bend wall surface 25*b* connected to the second diffuser wall surface 220 and positioned on the radially outer side of the central axis AXrb. The return bend 25 according to some embodiments is sandwiched between the first bend wall surface 25*a* and the second bend wall surface 25*b*.

The return channel 27 allows the working fluid which is turned toward the radially inner side at the return bend 25, to enter the impeller 4 in the next stage. The return channel 27 has a return vane 29.

The multi-stage centrifugal compressor 100 according to some embodiments has a first return wall surface 27*a* connected to the first bend wall surface 25*a* and positioned on the axially upstream side. The multi-stage centrifugal compressor 100 according to some embodiments has a second return wall surface 27*b* connected to the second bend wall surface 25*b* and positioned on the axially downstream side. The return channel 27 according to some embodiments is sandwiched between the first return wall surface 27*a* and the second return wall surface 27*b*.

In other words, the first return wall surface 27*a* is connected to the first diffuser wall surface 210, and the second return wall surface 27*b* is connected to the second diffuser wall surface 220.

Figure 4:
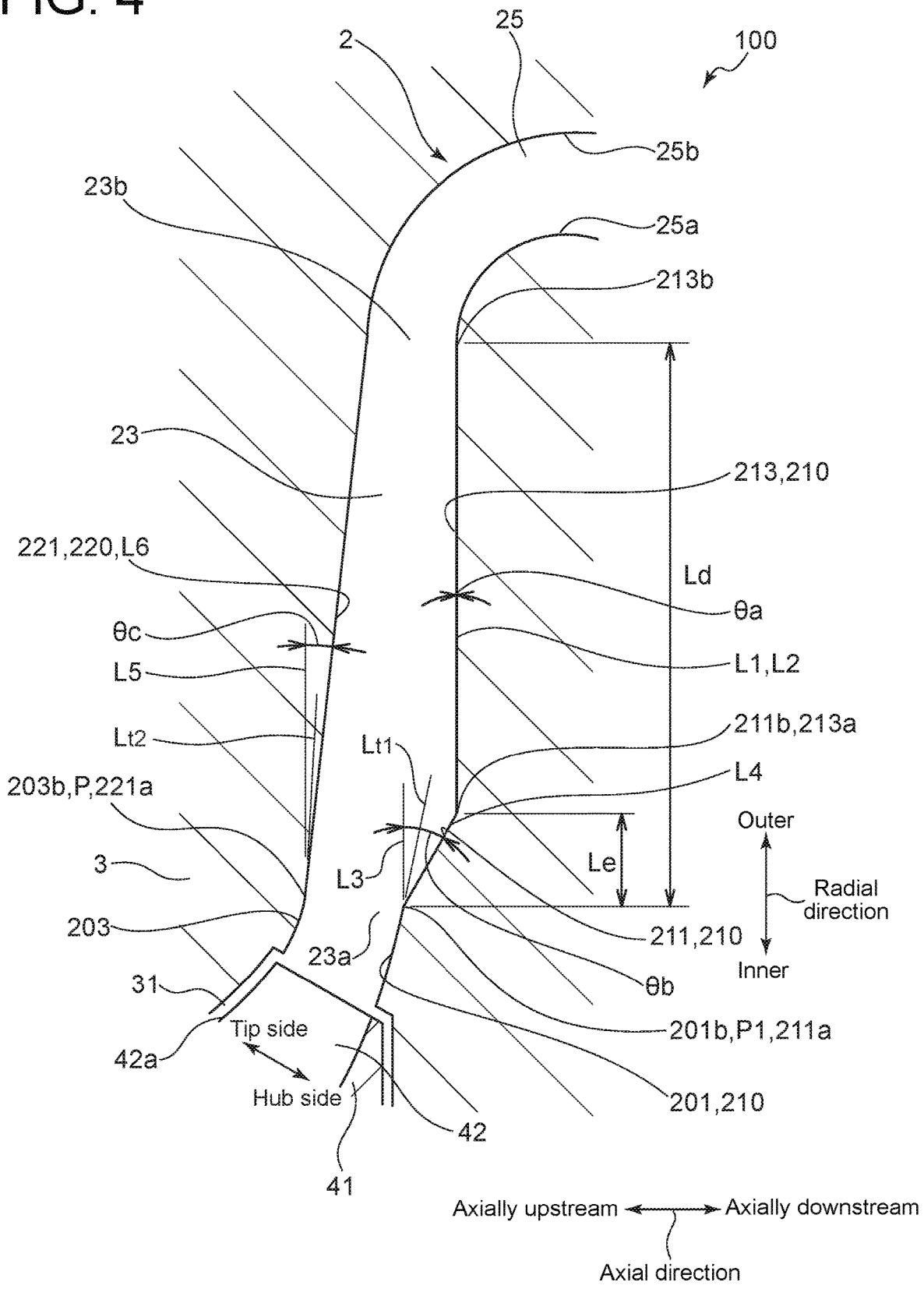
FIG. 4 is a schematic enlarged view of a part of FIG. 2.
Figure 5:
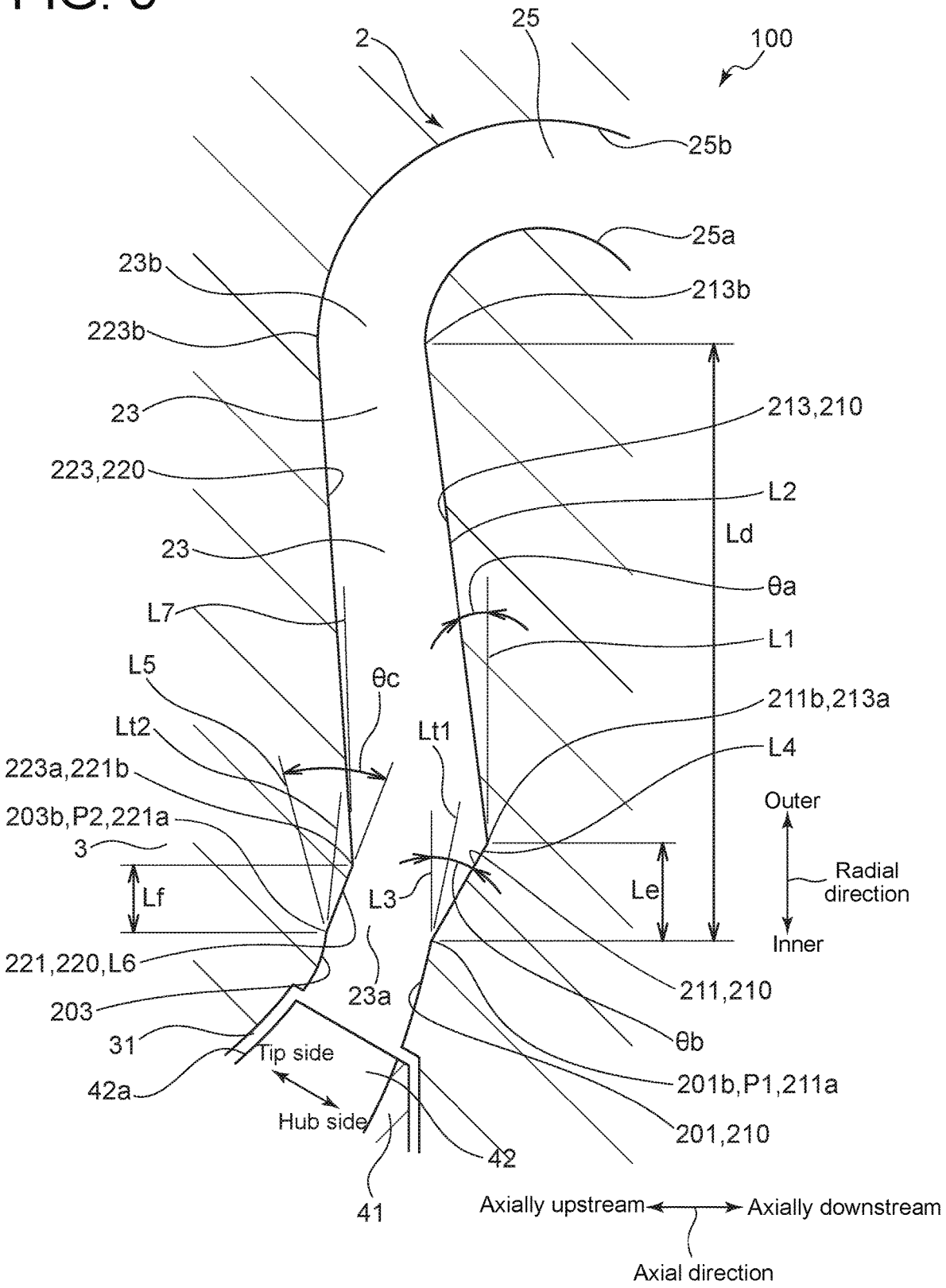
FIG. 5 is a schematic enlarged view of a part of FIG. 3.

FIG. 4 is a schematic enlarged view of a part of FIG. 2. FIG. 5 is a schematic enlarged view of a part of FIG. 3. With reference to FIGS. 2 and 5, details of the flow path 2 according to some embodiments will now be described.

(Separation of Working Fluid G in Return Channel 27)

In the multi-stage centrifugal compressor 100, separation of the working fluid may occur at the first return wall surface 27*a*, connected to the first diffuser wall surface 210, of the pair of wall surfaces (first return wall surface 27*a* and second return wall surface 27*b*) of the return channel 27. The present inventors have keenly studied and consequently found that the separation is likely to occur in case of using an open impeller, i.e., an impeller 4 having no cover on the tip side.

Specifically, when an open impeller is used as the impeller 4 of the multi-stage centrifugal compressor 100, a tip clearance 31 is provided between a tip-side end 42*a* of the impeller 4 and the casing. Therefore, due to the presence of the tip clearance 31, the flow velocity of the working fluid G at the tip side tends to be lower than at the hub side in an outlet-side portion of the impeller 4. The difference in flow velocity of the working fluid G at the outlet side of the impeller 4 also affects the flow velocity of the working fluid G in the diffuser channel 23. At the outlet of the diffuser channel 23, the flow velocity in the vicinity of the second diffuser wall surface 220 tends to be lower than the flow velocity in the vicinity of the first diffuser wall surface 210.

As described above, in the multi-stage centrifugal compressor 100, the diffuser channel 23 and the return channel 27 are connected by the return bend 25. The first diffuser wall surface 210 is connected to the first bend wall surface 25*a* on the radially inner side of the return bend 25, and the second diffuser wall surface 220 is connected to the second bend wall surface 25*b* on the radially outer side of the return bend 25.

The working fluid G flowing out from the diffuser channel 23 toward the radially outer side turns at the return bend 25 toward the radially inner side and flows into the return channel 27. At this time, if the flow velocity of the working fluid G flowing in the vicinity of the first diffuser wall surface 210 is higher than the flow velocity of the working fluid G flowing in the vicinity of the second diffuser wall surface 220, the working fluid G flowing in the vicinity of the first diffuser wall surface 210 cannot sufficiently turn at the return bend 25. As a result, in the return channel 27, the working fluid G easily separates at the first return wall surface 27*a* connected to the first diffuser wall surface 210.

As a result of intensive studies by the present inventors, it was found that when the first diffuser wall surface 210 has a retreating surface 211, which will be described later in detail, a hub-side flow-path cross-sectional area is increased in an inlet-side region of the diffuser channel 23. Accordingly, compared to the case where the first diffuser wall surface 210 does not have the retreating surface 211, it is possible to reduce the flow velocity of the working fluid G flowing in the vicinity of the first diffuser wall surface 210 in the inlet-side region of the diffuser channel 23. Thus, since the difference between the flow velocity in the vicinity of the first diffuser wall surface 210 and the flow velocity in the vicinity of the second diffuser wall surface 220 is reduced, the working fluid G flowing in the vicinity of the first diffuser wall surface 210 easily turns at the return bend 25. Therefore, in the return channel 27, it is possible to suppress separation of the working fluid G at a wall surface connected to the first bend wall surface 25*a*, i.e., at the first return wall surface 27*a* connected to the first diffuser wall surface 210.

(Retreating Surface 211)

With reference to FIGS. 2 to 5, the retreating surface 211 will be described.

As shown in FIGS. 2 to 5, the first diffuser wall surface 210 according to some embodiments has the retreating surface 211 retreating (leaning) toward the hub side from a connection position P1 with a downstream end 201*b* of a first upstream wall surface 201, which is positioned upstream of the first diffuser wall surface 210 and connected to the first diffuser wall surface 210, to the radially outer side, with respect to a tangent Lt1 to the first upstream wall surface 201 at the downstream end 201*b* of the first upstream wall surface 201.

In some embodiments, the presence of the retreating surface 211 increases the width of the diffuser channel 23 downstream (as it approaches the outlet of the diffuser channel 23) at the inlet side of the diffuser channel 23. The provision of the retreating surface 211 on the first diffuser wall surface 210 reduces the flow velocity of the working fluid G flowing along the first diffuser wall surface 210 in the vicinity of the first diffuser wall surface 210. Accordingly, it is possible to reduce the flow velocity of the working fluid G flowing in the vicinity of the first diffuser wall surface 210 at the outlet side of the diffuser channel 23. Therefore, since the working fluid G flowing in the vicinity of the first diffuser wall surface 210 easily turns at the return bend 25, it is possible to suppress separation of the working fluid G at the first return wall surface 27*a*.

(First Outer Wall Surface of First Diffuser Wall surface 210)

As shown in FIGS. 2 to 5, the first diffuser wall surface according to some embodiments has a first outer wall surface 213 positioned on the radially outer side of the retreating surface 211.

As shown in FIG. 4, in a cross-section along the axial direction, a downstream end 213*b* of the first outer wall surface 213 is situated on a line L1 extending from an upstream end 213*a* of the first outer wall surface 213 toward the radially outer side. However, in a cross-section along the axial direction, the downstream end 213*b* of the first outer wall surface 213 may be situated at a position retreating (displaced) toward the hub side from the line L1.

Additionally, the first outer wall surface 213 is disposed such that, in a cross-section along the axial direction, an angle θa between the line L1 extending from the upstream end 213*a* of the first outer wall surface 213 toward the radially outer side and a line L2 extending from the upstream end 213*a* of the first outer wall surface 213 toward the downstream end 213*b* of the first outer wall surface 213 is smaller than an angle θb between a line L3 extending from an upstream end 211*a* of the retreating surface 211 toward the radially outer side and a line L4 extending from the upstream end 211*a* of the retreating surface 211 toward a downstream end 211*b* of the retreating surface 211.

With this configuration, although the retreating surface 211 is inclined toward the axial direction with respect to the radial direction, the inclination of the first outer wall surface 213 toward the axial direction is controlled compared to the retreating surface 211. Thus, the downstream end 213*b* of the first outer wall surface 213 is positioned further axially upstream compared to the case where the inclination of the first outer wall surface 213 toward the axial direction is not controlled. This enables a reduction in the length of the rotational shaft 1 of the multi-stage centrifugal compressor 100, thus suppressing the occurrence of vibration of the rotational shaft 1. Further, since the length of the rotational shaft 1 of the multi-stage centrifugal compressor 100 is reduced, it is possible to prevent an increase in axial dimension of the multi-stage centrifugal compressor 100.

In some embodiments, the upstream end 213*a* of the first outer wall surface 213 is connected to the downstream end 211*b* of the retreating surface 211.

In the embodiment shown in FIG. 5, the first outer wall surface 213 is disposed such that, in a cross-section along the axial direction, the downstream end 213*b* of the first outer wall surface 213 is situated at a position projecting toward the tip side from the line L1 extending from the upstream end 213*a* of the first outer wall surface 213 toward the radially outer side.

With this configuration, the downstream end 213*b* of the first outer wall surface 213 is positioned axially upstream of the line L1. Thus, the downstream end 213*b* of the first outer wall surface 213 is positioned further axially upstream compared to the case where the downstream end 213*b* of the first outer wall surface 213 is positioned axially downstream of the line L1. This enables a reduction in the length of the rotational shaft 1 of the multi-stage centrifugal compressor 100, thus suppressing the occurrence of vibration of the rotational shaft 1. Further, since the length of the rotational shaft 1 of the multi-stage centrifugal compressor 100 is reduced, it is possible to prevent an increase in axial dimension of the multi-stage centrifugal compressor 100.

(Second Diffuser Wall Surface 220)

As shown in FIGS. 2 to 5, the second diffuser wall surface 220 according to some embodiments has a projecting surface 221 projecting toward the hub side from a connection position P2 with a downstream end 203*b* of a second upstream wall surface 203, which is positioned upstream of the second diffuser wall surface 220 and connected to the second diffuser wall surface 220, to the radially outer side, with respect to a tangent Lt2 to the second upstream wall surface 203 at the downstream end 203*b* of the second upstream wall surface 203.

As a result of intensive studies by the present inventors, it was found that when the second diffuser wall surface 220 does not have the projecting surface 221, the flow-path cross-sectional area in an outlet-side region of the diffuser channel 23 relatively increases, and the flow velocity of the working fluid G decreases in the vicinity of the second diffuser wall surface 220, which may cause backflow of the working fluid G from the return bend 25.

With the above configuration, since the flow-path cross-sectional area of the diffuser channel 23 is reduced compared to the case where the second diffuser wall surface 220 does not have the projecting surface 221, it is possible to suppress backflow of the working fluid G from the return bend 25 as described above. Further, with the above configuration, it is possible to reduce the thickness of a boundary layer where the flow velocity is decreased due to the influence of the second diffuser wall surface 220 in the vicinity of the second diffuser wall surface 220.

In some embodiments, for example as shown in FIG. 5, the second diffuser wall surface 220 is disposed such that, in a cross-section along the axial direction, a downstream end 221*b* of the projecting surface 221 is situated at a position projecting toward the hub side from a line L5 extending from an upstream end 221*a* of the projecting surface 221 toward the radially outer side. However, in a cross-section along the axial direction, the downstream end 221*b* of the projecting surface 221 may be situated on the line L5.

Additionally, the second diffuser wall surface 220 may be disposed such that, in a cross-section along the axial direction, an angle θc between the line L5 extending from the upstream end 221*a* of the projecting surface 221 toward the radially outer side and a line L6 extending from the upstream end 221*a* of the projecting surface 221 toward the downstream end 211*b* of the projecting surface 221 is smaller than the angle θb between the line L3 extending from the upstream end 211*a* of the retreating surface 211 toward the radially outer side and the line L4 extending from the upstream end 211*a* of the retreating surface 211 toward the downstream end 211*b* of the retreating surface 211.

With this configuration, the downstream end 221*b* of the projecting surface 221 is positioned further axially upstream compared to the case where the angle θc between the line L5 and the line L6 is greater than the angle θb between the line L3 and the line L4. This prevents the downstream end 221*b* of the projecting surface 221 from coming excessively close to the first diffuser wall surface 210, thus ensuring the flow-path cross-sectional area of the diffuser channel 23.

For example, as shown in FIG. 5, the second diffuser wall surface 220 may have a second outer wall surface 223 positioned on the radially outer side of the projecting surface 221.

The second outer wall surface may be disposed such that, in a cross-section along the axial direction, the downstream end 223*b* of the second outer wall surface 223 is situated at a position retreating toward the tip side from a line L7 extending from the upstream end 223*a* of the second outer wall surface 223 toward the radially outer side.

With this configuration, the downstream end 223*b* of the second outer wall surface 223 is positioned further axially upstream compared to the case where the downstream end 223*b* of the second outer wall surface 223 is positioned at a position projecting toward the hub side from the line L7 extending from the upstream end 223*a* of the second outer wall surface 223 toward the radially outer side. This prevents the downstream end 223*b* of the second outer wall surface 223 from coming excessively close to the first diffuser wall surface 210, thus ensuring the flow-path cross-sectional area of the diffuser channel 23. Moreover, since the flow-path cross-sectional area of the diffuser channel 23 is ensured as described above, it is unnecessary to dispose a region of the first diffuser wall surface 210 facing the downstream end 223*b* of the second outer wall surface 223 further axially downstream than necessary. Thus, it is possible to reduce the length of the rotational shaft 1 of the multi-stage centrifugal compressor 100.

In the embodiment shown in FIG. 5, the upstream end 223*a* of the second outer wall surface 223 is connected to the downstream end 221*b* of the projecting surface 221.

As shown in FIGS. 2 to 5, in some embodiments, the angle θc between the line L5 extending from the upstream end 221*a* of the projecting surface 221 toward the radially outer side and the line L6 extending from the upstream end 221*a* of the projecting surface 221 toward the downstream end 221*b* of the projecting surface 221 is smaller than the angle θb between the line L3 extending from the upstream end 211*a* of the retreating surface 211 toward the radially outer side and the line L4 extending from the upstream end 211*a* of the retreating surface 211 toward the downstream end 211*b* of the retreating surface 211.

With this configuration, since the distance to the projecting surface 221 increases from the upstream end 211*a* to the downstream end 211*b* of the retreating surface 211, it is possible to reduce the flow velocity of the working fluid flowing in the vicinity of the first diffuser wall surface 210 in the inlet-side region of the diffuser channel 23.

In some embodiments described above, the length Le of the retreating surface 211 in the radial direction is more than 5% and equal to or less than 20% of the length Ld of the first diffuser wall surface in the radial direction.

As a result of intensive studies by the present inventors, it was found that when the length Le of the retreating surface 211 in the radial direction is equal to or less than 5% of the length Ld of the first diffuser wall surface 210 in the radial direction, the effect of reducing the flow velocity of the working fluid G flowing in the vicinity of the first diffuser wall surface 210 in the inlet-side region of the diffuser channel 23 is decreased. Accordingly, by setting the length Le to more than 5% of the length Ld, it is possible to effectively reduce the flow velocity of the working fluid G flowing in the vicinity of the first diffuser wall surface 210 in the inlet-side region of the diffuser channel 23.

Meanwhile, as the length Le of the retreating surface 211 in the radial direction increases, in addition to that the effect of reducing the flow velocity of the working fluid G increases, the length of the rotational shaft 1 increases since the downstream end 211*b* of the retreating surface 211 is positioned axially downstream. Therefore, vibration of the rotational shaft 1 may easily occur.

As a result of intensive studies by the present inventors, it was found that when the length Le of the retreating surface 211 in the radial direction is equal to or less than 20% of the length Ld of the first diffuser wall surface 210 in the radial direction, vibration of the rotational shaft 1 is suppressed while ensuring the effect of reducing the flow velocity of the working fluid G as much as possible. Accordingly, by setting the length Le to equal to or less than 20% of the length Ld, it is possible to suppress vibration of the rotational shaft 1 while ensuring the effect of reducing the flow velocity of the working fluid G as much as possible.

The length Lf of the projecting surface 221 in the radial direction is shorter than the length Le of the retreating surface 211 in the radial direction.

In some embodiments shown in FIGS. 2 to 5, the angle θb between the line L3 extending from the upstream end 211*a* of the retreating surface 211 toward the radially outer side and the line L4 extending from the upstream end 211*a* of the retreating surface 211 toward the downstream end 211*b* of the retreating surface 211 is more than 5° and less than 10°.

As a result of intensive studies by the present inventors, it was found that when the angle θb is equal to or less than 5°, the effect of reducing the flow velocity of the working fluid G flowing in the vicinity of the first diffuser wall surface 210 in the inlet-side region of the diffuser channel 23 is decreased. Accordingly, by setting the angle θb to more than 5°, it is possible to effectively reduce the flow velocity of the working fluid G flowing in the vicinity of the first diffuser wall surface 210 in the inlet-side region of the diffuser channel 23.

Meanwhile, as the angle θb increases, in addition to that the effect of reducing the flow velocity of the working fluid G increases, the length of the rotational shaft 1 may increase since the downstream end 211*b* of the retreating surface 211 is positioned axially downstream. Therefore, vibration of the rotational shaft 1 may easily occur.

As a result of intensive studies by the present inventors, it was found that when the angle θb is less than 10°, vibration of the rotational shaft 1 is suppressed while ensuring the effect of reducing the flow velocity of the working fluid G as much as possible. Accordingly, by setting the angle θb to less than 10°, it is possible to suppress vibration of the rotational shaft 1 while ensuring the effect of reducing the flow velocity of the working fluid G as much as possible.

In some embodiments shown in FIGS. 2 to 5, with a distance between the first diffuser wall surface 210 and the second diffuser wall surface 220 at an inlet-side end 23*a* of the diffuser channel 23 being 100%, a distance between the first diffuser wall surface 210 and the second diffuser wall surface 220 at an outlet-side end 23*b* of the diffuser channel 23 is equal to or more than 90% and equal to or less than 110%.

When the distance at the outlet-side end 23*b* is less than 90% based on 100% at the inlet-side end 23*a* of the diffuser channel 23, the flow velocity in the diffuser channel 23 does not sufficiently decreases, resulting in an increase in pressure loss and a reduction in efficiency of the multi-stage centrifugal compressor 100. Accordingly, by setting the distance at the outlet-side end 23*b* to equal to or more than 90%, it is possible to suppress the reduction in efficiency of the centrifugal compressor. Meanwhile, when the distance at the outlet-side end 23*b* is more than 110%, the flow-path cross-sectional area in the outlet-side region of the diffuser channel 23 relatively increases, and, as described above, the flow velocity of the working fluid G decreases in the vicinity of the second diffuser wall surface 220, which may cause backflow of the working fluid G from the return bend 25. Accordingly, by setting the distance at the outlet-side end 23*b* to equal to or less than 110%, it is possible to suppress backflow of the working fluid from the return bend 25.

The present invention is not limited to the embodiments described above, but includes modifications to the embodiments described above, and embodiments composed of combinations of those embodiments.

For example, the multi-stage centrifugal compressor 100 may have the features of the first diffuser wall surface 210 in the embodiment shown in FIG. 4, and the features of the second diffuser wall surface 220 in the embodiment shown in FIG. 5. The multi-stage centrifugal compressor 100 may have the features of the second diffuser wall surface 220 in the embodiment shown in FIG. 4, and the features of the first diffuser wall surface 210 in the embodiment shown in FIG. 5.

Further, for instance, the diffuser channel 23 of the impeller 4 in the second or later stage may have the features of the first diffuser wall surface 210 and the second diffuser wall surface 220 shown in FIG. 4, or the features of the first diffuser wall surface 210 and the second diffuser wall surface 220 shown in FIG. 5.

The invention claimed is:

1. A multi-stage centrifugal compressor comprising:

multiple stages of impellers arranged in an axial direction;

a casing surrounding the impellers; and a diffuser channel for guiding a working fluid discharged from the impellers outward in a radial direction, wherein, in a cross-section along the axial direction, a first diffuser wall surface on a hub side of a pair of diffuser wall surfaces that are opposed in the axial direction across the diffuser channel has a retreating surface retreating toward the hub side from a connection position with a downstream end of a first upstream wall surface to a radially outer side with respect to a tangential direction of the first upstream wall surface at the downstream end of the first upstream wall surface, the first upstream wall surface being positioned upstream of the first diffuser wall surface and connected to the first diffuser wall surface, wherein a second diffuser wall surface on a tip side of the pair of diffuser wall surfaces has a projecting surface projecting toward the hub side from a connection position with a downstream end of a second upstream wall surface to the radially outer side with respect to a tangential direction of the second upstream wall surface at the downstream end of the second upstream wall surface, the second upstream wall surface being positioned upstream of the second diffuser wall surface and connected to the second diffuser wall surface, and wherein the second diffuser wall surface on the tip side is disposed such that, in a cross-section along the axial direction, a downstream end of the projecting surface is situated on a line extending from an upstream end of the projecting surface toward the radially outer side or at a position projecting toward the hub side from the line, and in a cross-section along the axial direction, an angle between the line extending from the upstream end of the projecting surface toward the radially outer side and a line extending from the upstream end of the projecting surface toward the downstream end of the projecting surface is smaller than an angle between a line extending from an upstream end of the retreating surface toward the radially outer side and a line extending from the upstream end of the retreating surface toward a downstream end of the retreating surface.

2. The multi-stage centrifugal compressor according to claim 1, wherein the second diffuser wall surface has a second outer wall surface positioned on the radially outer side of the projecting surface, and wherein the second outer wall surface is disposed such that, in a cross-section along the axial direction, a downstream end of the second outer wall surface is situated at a position retreating toward the tip side from a line extending from an upstream end of the second outer wall surface toward the radially outer side.

3. A multi-stage centrifugal compressor comprising:

multiple stages of impellers arranged in an axial direction;

a casing surrounding the impellers; and a diffuser channel for guiding a working fluid discharged from the impellers outward in a radial direction, wherein, in a cross-section along the axial direction, a first diffuser wall surface on a hub side of a pair of diffuser wall surfaces that are opposed in the axial direction across the diffuser channel has a retreating surface retreating toward the hub side from a connection position with a downstream end of a first upstream wall surface to a radially outer side with respect to a tangential direction of the first upstream wall surface at the downstream end of the first upstream wall surface, the first upstream wall surface being positioned upstream of the first diffuser wall surface and connected to the first diffuser wall surface, wherein a second diffuser wall surface on a tip side of the pair of diffuser wall surfaces has a projecting surface projecting toward the hub side from a connection position with a downstream end of a second upstream wall surface to the radially outer side with respect to a tangential direction of the second upstream wall surface at the downstream end of the second upstream wall surface, the second upstream wall surface being positioned upstream of the second diffuser wall surface and connected to the second diffuser wall surface, and wherein an angle between a line extending from an upstream end of the projecting surface toward the radially outer side and a line extending from the upstream end of the projecting surface toward a downstream end of the projecting surface is smaller than an angle between a line extending from an upstream end of the retreating surface toward the radially outer side and a line extending from the upstream end of the retreating surface toward a downstream end of the retreating surface.

4. A multi-stage centrifugal compressor comprising:

multiple stages of impellers arranged in an axial direction;

a casing surrounding the impellers; and a diffuser channel for guiding a working fluid discharged from the impellers outward in a radial direction, wherein, in a cross-section along the axial direction, a first diffuser wall surface on a hub side of a pair of diffuser wall surfaces that are opposed in the axial direction across the diffuser channel has a retreating surface retreating toward the hub side from a connection position with a downstream end of a first upstream wall surface to a radially outer side with respect to a tangential direction of the first upstream wall surface at the downstream end of the first upstream wall surface, the first upstream wall surface being positioned upstream of the first diffuser wall surface and connected to the first diffuser wall surface, wherein a length of the retreating surface in the radial direction is more than 5% and equal to or less than 20% of a length of the first diffuser wall surface in the radial direction.

5. A multi-stage centrifugal compressor comprising:

multiple stages of impellers arranged in an axial direction;

a casing surrounding the impellers; and a diffuser channel for guiding a working fluid discharged from the impellers outward in a radial direction, wherein, in a cross-section along the axial direction, a first diffuser wall surface on a hub side of a pair of diffuser wall surfaces that are opposed in the axial direction across the diffuser channel has a retreating surface retreating toward the hub side from a connection position with a downstream end of a first upstream wall surface to a radially outer side with respect to a tangential direction of the first upstream wall surface at the downstream end of the first upstream wall surface, the first upstream wall surface being positioned upstream of the first diffuser wall surface and connected to the first diffuser wall surface, wherein an angle between a line extending from an upstream end of the retreating surface toward the radially outer side and a line extending from the upstream end of the retreating surface toward a downstream end of the retreating surface is more than 5° and less than 10°.

6. A multi-stage centrifugal compressor comprising:

multiple stages of impellers arranged in an axial direction;

a casing surrounding the impellers; and a diffuser channel for guiding a working fluid discharged from the impellers outward in a radial direction, wherein, in a cross-section along the axial direction, a first diffuser wall surface on a hub side of a pair of diffuser wall surfaces that are opposed in the axial direction across the diffuser channel has a retreating surface retreating toward the hub side from a connection position with a downstream end of a first upstream wall surface to a radially outer side with respect to a tangential direction of the first upstream wall surface at the downstream end of the first upstream wall surface, the first upstream wall surface being positioned upstream of the first diffuser wall surface and connected to the first diffuser wall surface, and wherein, with a distance between the first diffuser wall surface on the hub side and a second diffuser wall surface on a tip side of the pair of diffuser wall surfaces at an inlet-side end of the diffuser channel being 100%, a distance between the first diffuser wall surface and the second diffuser wall surface at an outlet-side end of the diffuser channel is equal to or more than 90% and equal to or less than 110%.

* * * * *